US008650788B2

(12) United States Patent
Ostanin

(10) Patent No.: US 8,650,788 B2
(45) Date of Patent: Feb. 18, 2014

(54) SAFETY FOR A REPEATING RIFLE

(75) Inventor: Alexander Ostanin, Köln (DE)

(73) Assignee: Blaser Finanzholding GmbH, Isny (DE)

( * ) Notice: Subject to any disclaimer, the term of this patent is extended or adjusted under 35 U.S.C. 154(b) by 13 days.

(21) Appl. No.: 13/329,991

(22) Filed: Dec. 19, 2011

(65) Prior Publication Data

US 2012/0159830 A1 Jun. 28, 2012

(30) Foreign Application Priority Data

Dec. 22, 2010 (DE) ..... 10 2010 055 683

(51) Int. Cl.
*F41A 17/70* (2006.01)
*F41A 17/80* (2006.01)

(52) U.S. Cl.
USPC ..... 42/70.08

(58) Field of Classification Search
USPC ..... 42/70.01, 70.04, 70.05, 70.08
See application file for complete search history.

(56) References Cited

U.S. PATENT DOCUMENTS

| | | | | | |
|---|---|---|---|---|---|
| 282,941 | A | * | 8/1883 | Whitmore | 42/41 |
| 311,732 | A | * | 2/1885 | Ehbets | 42/70.06 |
| 365,383 | A | * | 6/1887 | Holladay | 42/70.08 |
| 531,132 | A | * | 12/1894 | Ostrander | 42/11 |
| 568,288 | A | * | 9/1896 | Bachmann et al. | 42/70.08 |
| 859,477 | A | * | 7/1907 | Aubrey | 42/41 |
| 1,100,766 | A | * | 6/1914 | Nelson et al. | 89/146 |
| 1,108,400 | A | * | 8/1914 | Savage | 42/21 |
| 1,125,633 | A | * | 1/1915 | Baker | 42/45 |
| 1,145,036 | A | * | 7/1915 | Schmid | 42/45 |
| 1,302,909 | A | * | 5/1919 | Giddings | 42/41 |
| 2,001,279 | A | * | 5/1935 | Loomis | 42/70.04 |
| 2,125,933 | A | * | 8/1938 | Lewis | 42/70.05 |
| 2,818,669 | A | * | 1/1958 | Claude et al. | 42/16 |
| 2,871,606 | A | * | 2/1959 | Butler et al. | 42/70.04 |
| 3,234,679 | A | * | 2/1966 | Benson | 42/70.06 |
| 3,673,725 | A | * | 7/1972 | Cravener | 42/70.11 |
| 3,747,251 | A | * | 7/1973 | Baker | 42/70.04 |
| 3,857,324 | A | * | 12/1974 | Tant | 89/197 |
| 3,949,508 | A | | 4/1976 | Elkas | |
| 4,024,664 | A | * | 5/1977 | Murabito | 42/70.08 |
| 4,270,295 | A | * | 6/1981 | Grehl | 42/70.08 |
| 4,494,331 | A | * | 1/1985 | Vanderbeck | 42/70.05 |
| 4,744,166 | A | * | 5/1988 | Mattarelli | 42/69.01 |
| 4,866,869 | A | * | 9/1989 | Mainland | 42/70.08 |

(Continued)

FOREIGN PATENT DOCUMENTS

| | | |
|---|---|---|
| AT | 507905 T | 5/2011 |
| DE | 1235187 B | 2/1967 |

(Continued)

*Primary Examiner* — Bret Hayes
(74) *Attorney, Agent, or Firm* — Fleit Gibbons Gutman Bongini & Bianco PL; Martin Fleit; Paul D. Bianco

(57) ABSTRACT

The invention relates to a safety for a repeating rifle, with a safety slider (4) arranged displaceably between a safety position and an unsecured position on a lock (2), and a locking element associated with the safety slider (4) for blocking or releasing a firing pin nut (8) displaceably arranged in the lock (2). The locking element according to the invention is constructed as a safety lever (22), rotatable about a transverse pin (24), with a control part (23) engaging with a control groove (19) on the firing pin nut (8).

13 Claims, 4 Drawing Sheets

(56) References Cited

U.S. PATENT DOCUMENTS

| | | | | | |
|---|---|---|---|---|---|
| 4,926,574 | A | | 5/1990 | Rieger | |
| 4,962,606 | A | * | 10/1990 | Pozzi | 42/70.08 |
| 5,458,046 | A | * | 10/1995 | Blenk et al. | 89/190 |
| 5,465,518 | A | * | 11/1995 | Blaser | 42/70.08 |
| 5,560,132 | A | * | 10/1996 | Merlino | 42/66 |
| 6,131,325 | A | * | 10/2000 | Kefer | 42/70.05 |
| 7,908,779 | B2 | * | 3/2011 | Wasmer | 42/1.05 |
| 2010/0229443 | A1 | * | 9/2010 | Wasmer | 42/1.05 |

FOREIGN PATENT DOCUMENTS

| | | | | | |
|---|---|---|---|---|---|
| DE | 6924780 | U | | 11/1969 | |
| DE | 1816404 | A1 | | 7/1970 | |
| DE | 3735773 | A1 | | 5/1989 | |
| DE | 100 08 394 C 1 | | * | 7/2001 | F41A 17/32 |
| DE | 10008394 | C1 | | 7/2001 | |
| DE | 102007015606 | A1 | | 10/2008 | |

* cited by examiner

SAFETY FOR A REPEATING RIFLE

FIELD OF THE INVENTION

The invention relates to a safety for a repeating rifle.

BACKGROUND OF THE INVENTION

Such a safety is known from DE PS 1 235 187. Therein, a safety slider displaceable between a safety position and an unsecured position is mounted on a so-called lock. A locking element for blocking or releasing a firing pin nut movably guided in the lock is assigned to a safety slider serving as an actuation element. In this known safety, the locking element is configured as a spherical or roller-shaped rolling element for engagement in a keyway of the firing pin nut. Large operating forces are necessary, however, because the transmission ratio in this case is low and the friction of the cooperating parts is relatively high. Lifting the firing spring nut off of the sear arm against the force of the firing pin spring is associated with a large exertion of force.

SUMMARY OF THE INVENTION

An object of the invention is to create a safety of the type mentioned above that has a high degree of safety with an extremely compact construction and a small expenditure of force.

In the safety according to the invention, the locking element is constructed as a safety lever rotatable about a transverse pin, with a control part engaging with a control groove on the firing pin nut. Thereby an extremely compactly constructed and conveniently operable safety with a high safety standard can be achieved. This safety can be safely used even with a low exertion of force, whereby the handling of the repeating rifle can be improved.

In an advantageous embodiment, the safety lever comprises a rear control edge for engagement with a front cam surface of the firing pin nut. In case of a displacement of the safety slider into the safety position, the firing pin nut can thus be displaced in a controlled manner into a rear safety position.

For easy connection to the safety slider, the safety lever expediently comprises a rounded-off upper part for engagement in a groove on the underside of the safety slider.

In order to prevent an unintended operation of the safety slider, an additional securing element for detachably holding the safety slider in the safety and unsecured positions is provided on the safety slider. The securing element can be formed as a pushbutton displaceable in the safety slider, for example. In a particularly expedient configuration, the safety slider is constructed in such a manner that a rear part of the securing element, as viewed in the direction of movement of the safety slider into the upper, unsecured position, is flush with the upper side of the safety slider or slightly offset from the inside, while a front part projects relative to the upper side of the safety slider 4. Thereby an unintended actuation of the securing element 6 can be avoided.

In another advantageous embodiment of the invention, a chamber connected to the lock comprises a locking groove for locking engagement with a protrusion on a sear arm in the safety position of the safety slider. A rotation and therefore an opening of the chamber can be prevented by the engagement of the protrusion with the locking groove of the chamber. Additional safety can be achieved in this manner.

BRIEF DESCRIPTION OF THE DRAWINGS

Additional details and advantages of the invention emerge from the following description of a preferred embodiment with reference to the drawings. Therein.

DETAILED DESCRIPTION OF THE INVENTION

Figure 1:
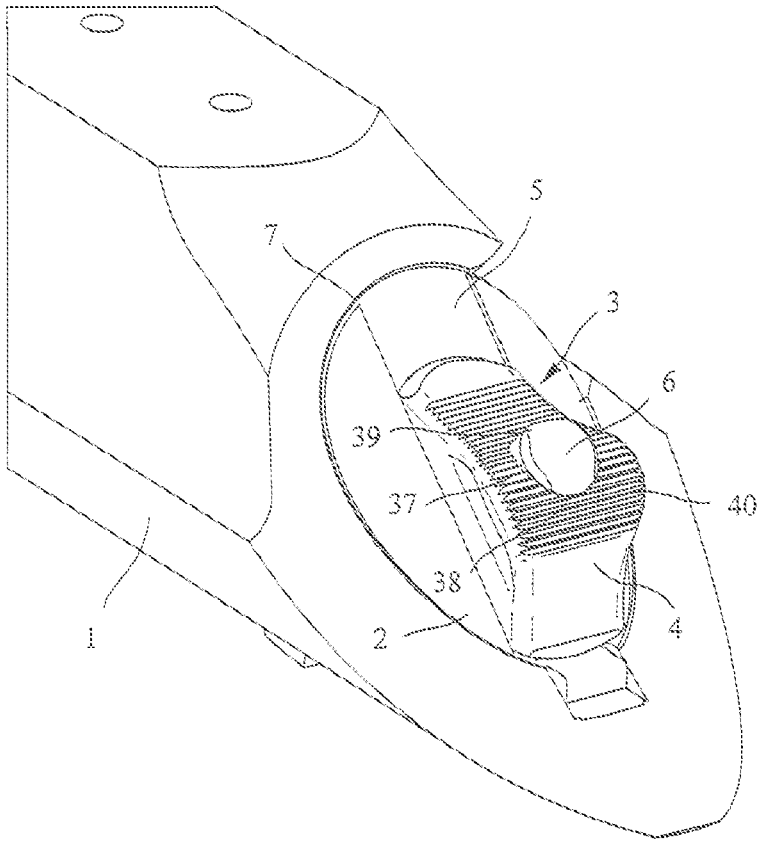
FIG. 1 shows a part of the system housing of a repeating rifle with a lock and a safety integrated into the lock, in a perspective view.

FIG. 1 shows the rear part of the system housing 1 of a repeating rifle with a so-called lock 2 and a safety 3 integrated into the lock 2 in a perspective view from the rear. The safety 3 contains a slider 4 that is displaceably guided inside a groove 5 on an inclined rear side of the lock 2 between a lower safety position and an upper unsecured position and is detachably held in the safety and unsecured positions by means of a securing element 6 configured as a pushbutton. The lock 2 arranged in a rear opening 7 of the system housing 1 is used in a conventionally known manner to guide a firing pin nut 8 shown in FIG. 2 that is guided displaceably in the longitudinal direction inside the lock 2.

Figure 2:
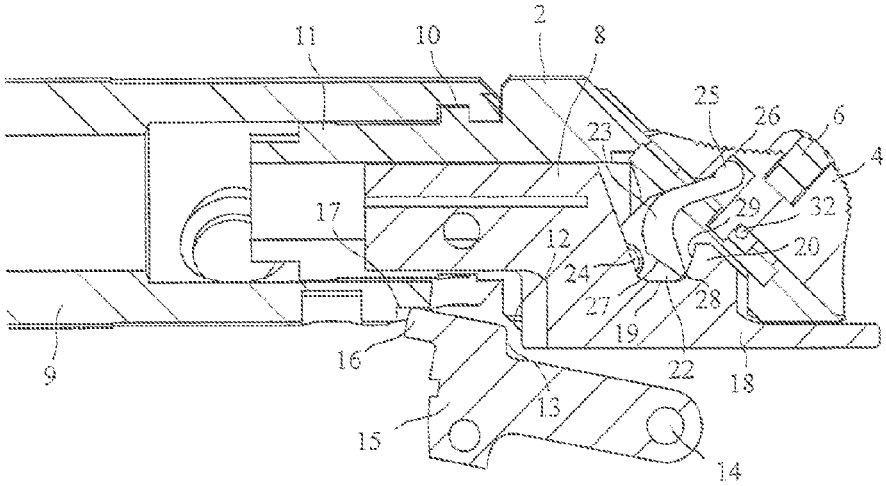
FIG. 2 shows a longitudinal section of the lock with integrated safety shown in FIG. 1, in a safety position.

As is seen from FIG. 2, a hollow cylindrical chamber 9 is axially secured at its rear end via radial locking elements 10 in the manner of a bayonet fastener and is rotatably connected to a front part 11 of the lock. The firing pin nut 8, fixed in the known manner to the rear end of a firing pin, not shown here, contains a step-like shoulder with a front catch surface 12 for engagement with a rear catch surface 13 of a sear arm 15 rotatable about a transverse shaft 14. At its front end, the sear arm 15 has a protrusion 16 for locking engagement with a locking groove 17 of the chamber 9.

Figure 4:
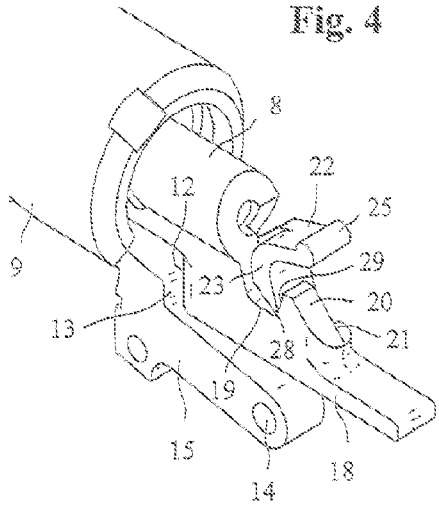
FIG. 4 shows a perspective view of the firing pin nut and the safety lever in the position of FIG. 2.
Figure 5:
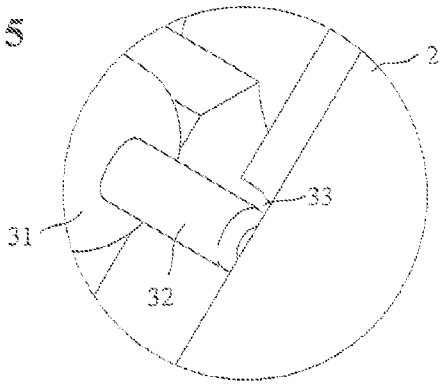
FIG. 5 shows the detail A from FIG. 3.

It can be seen in FIG. 4 that the firing pin nut 8 has, on the upper side of a web 18 projecting to the rear, a control groove 19 with a rear control tab 20 and a lateral milled area with an upper locking face 21. A safety lever 22 with a control part 23 engaged with the control groove 19 is arranged in the lateral milled area. The safety lever 22 is rotatable about a transverse pin 24 seen in FIG. 2 seated at one end in the firing pin nut 8 and has a rounded-off upper part 25 on the upper side for engagement in a groove 26 on the underside of the slider 4. The lateral control part 23, rounded off on its front side, has a lower flat surface 27 and a rear control edge 28 that cooperates with a front cam surface 29 on the front side of the control tab 20.

Figure 3:
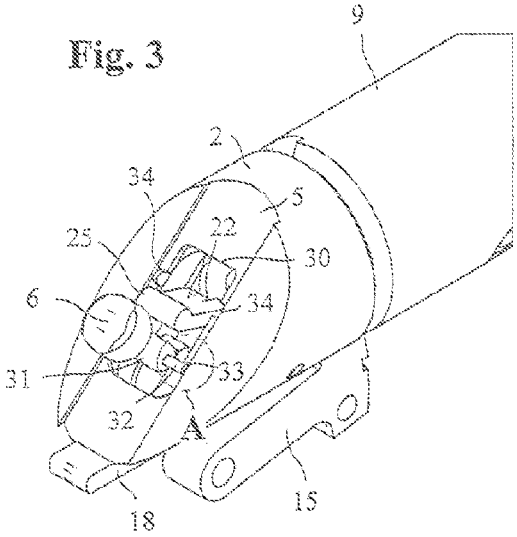
FIG. 3 shows the lock with the safety shown in FIG. 1 in the position of FIG. 2 with the slider removed.

A transverse pin 32 seen in FIG. 3 and intended for click-stop engagement with upper and lower catch grooves 33 and 34 on the sides of a passage opening 30 is provided at the lower end 31, projecting through the passage opening 30 on the rear side of the lock 2, of the securing element 6, constructed as a pushbutton pressed upwards by a spring, not shown. The rounded-off upper part 25 of the safety lever 22 also projects through the passage opening 30 for engagement with the groove 26 of the slider 4.

Below, the function of the above-described safety will be explained with reference to FIGS. 2-13.

In the safety position shown in FIGS. 2-5, the slider 4 is in a lower position. The safety lever 22 is rotated to the rear by the slider 4, with the firing pin nut 8 being pulled back via the rear control edge 28 of the safety lever 22 contacting the cam surface 29 of the control tab 20. The firing pin nut 8 is drawn back in the safety position sufficiently that there is a clearance between the rear catch surface 13 of the sear arm 15 and the front catch surface 12 of the firing pin groove 8, and thus the protrusion 16 of the sear arm 15 pressed upwards by a spring can come into locking engagement with the locking groove 17 of the chamber 9. A rotation and therefore an opening of the chamber 9 can be prevented by the engagement of the protrusion 16 with the locking groove 17 of the chamber 9. In the safety position shown, the transverse pin 32, arranged at the lower end 31 of the securing element 6, constructed as a pushbutton and pressed upwards by a spring, engages with the lower catch grooves 33, whereby an unintended displacement of the slider 4 is prevented. In the lower, safety position of the slider 4, retained and locked by the securing element 6, not only is the firing pin nut kept withdrawn to prevent firing, but opening of the chamber 9 is also prevented.

To displace the slider 4 upwards, the securing element 6, constructed as a pushbutton, must first be operated. The transverse pin 32 comes out of the catch grooves 33 only if the securing element 6 is pressed downwards against a spring, not shown, so that the slider 4 can move upwards into the unsecured position shown in FIGS. 6-9. If the securing element 6, constructed as a pushbutton, is released in the upper position, the transverse pin 32 moves into the upper catch grooves 34, so that slider 4 is held locked in the upper, unsecured position.

Figure 6:
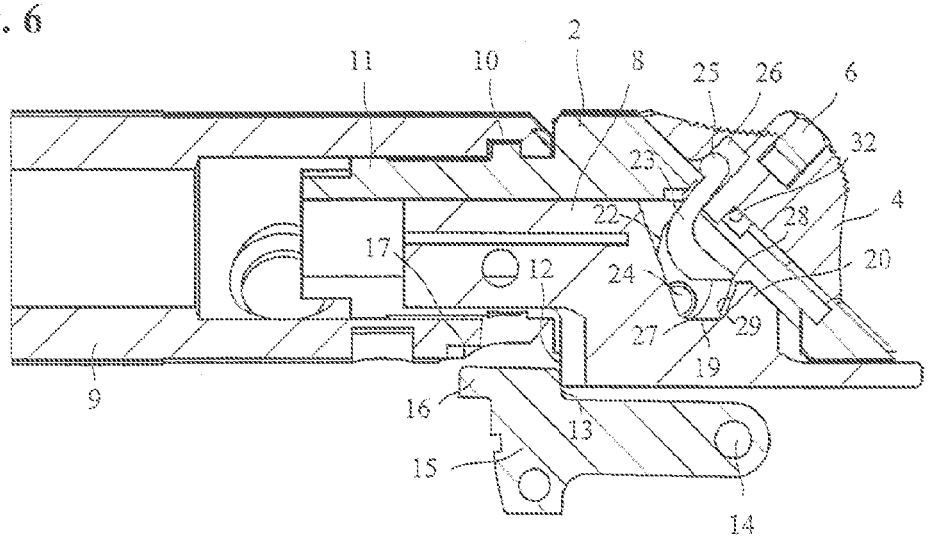
FIG. 6 shows a longitudinal section of the lock with the firing pin nut shown in FIG. 1 with the firing pin nut in a cocked position and the safety in an unsecured position.
Figure 7:
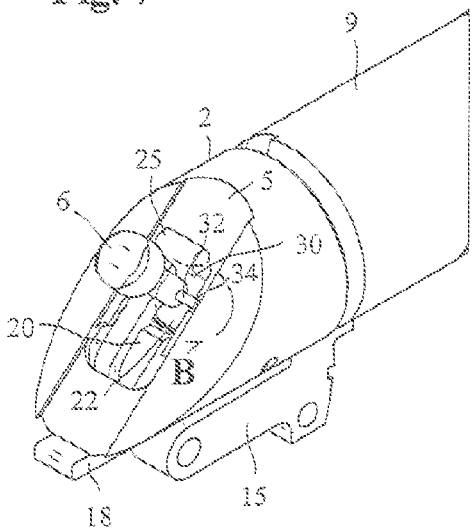
FIG. 7 shows the lock and the safety in the position of FIG. 6 with the slider removed.
Figure 8:
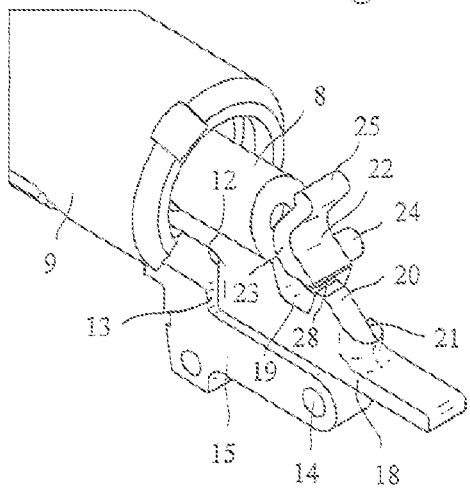
FIG. 8 shows a perspective view of the firing pin nut and the safety lever in the position of FIG. 6.
Figure 9:
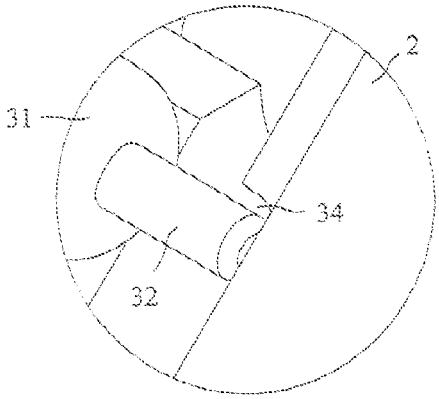
FIG. 9 shows the detail B from FIG. 7.

If the slider 4 is pushed upwards according to FIG. 6, the safety lever 22, rotatably supported on the transverse shaft 24, is rotated forward, so that the rear control edge 28 moves upwards along the cam surface 29 on the control tab 20 and comes entirely out of engagement with the cam surface 29 on the control tab 20 in the upper, unsecured position of the slider 4. Thereby the firing pin nut 8 can move forward until the upper catch surface 12 of the firing pin nut 8 comes to rest against the lower catch surface 13 of the sear arm, as shown in FIG. 6. The sear arm is also rotated downward by the movement of the firing pin nut 8, until the protrusion 16 on the sear arm 15 disengages from the locking groove 17 on the chamber 9. In the position of FIG. 6, in which the repeating rifle is cocked and ready to fire a shot, there is play between the lower flat surface 27 of the control part 23 on the safety lever 22 and the upper edge of the securing tab, so that the firing pin nut 8 can move forward under the control part 23 to fire a shot.

If the trigger is pressed in the position of FIG. 6, the sear arm 15 is rotated downwards about the shaft 14, so that the lower catch surface 13 of the sear arm 15 disengages from the front catch surface 12 of the firing pin nut 8 and releases the firing pin nut 8. Thereby the firing pin with the firing pin nut 8 can strike towards the front under the force of a firing pin spring, not shown, and reach the position after a shot has been fired, as shown in FIG. 10.

Figure 10:
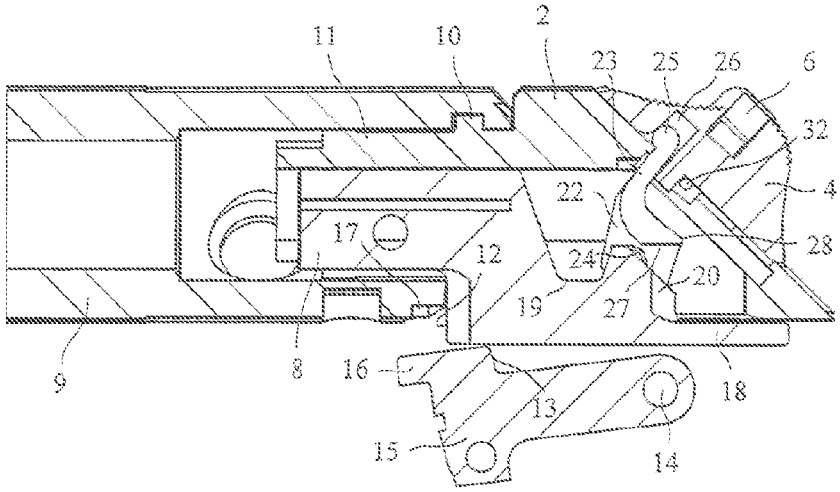
FIG. 10 shows a longitudinal section of the lock with the firing pin nut shown in FIG. 1 in a position after a shot has been fired and the safety in the unsecured position.
Figure 11:
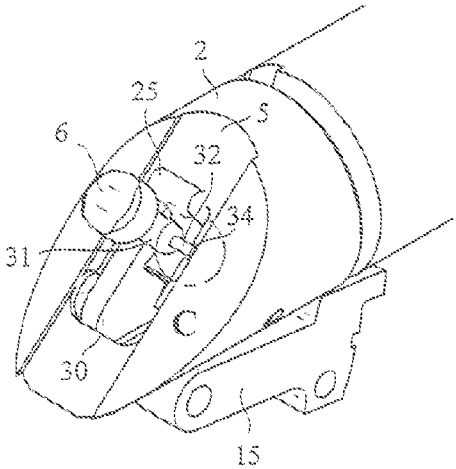
FIG. 11 shows the lock and the safety in the position of FIG. 10 with the slider removed.
Figure 12:
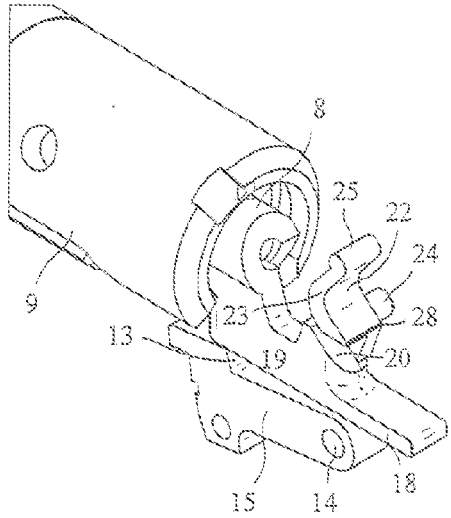
FIG. 12 shows a perspective view of the firing pin nut and the safety lever in the position of FIG. 10.
Figure 13:
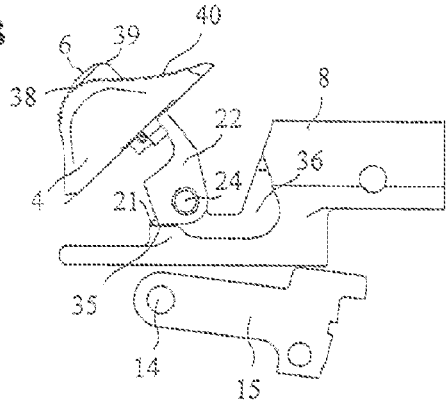
FIG. 13 shows a detailed view of the safety in the position of FIG. 10 from the other side.

FIG. 13 shows the safety lever 22 from another side in the position after a shot has been fired as shown in FIG. 10. It can be seen from this representation that the safety lever 22 has a lower locking face 35 on its underside that lies directly above the upper locking face 21 on the lateral milled surface 36, seen here, of the firing pin nut 8, after the firing pin has fired a shot. The lower locking face 35 is designed so that, in the unsecured position of the safety slider 4, it runs parallel to the upper locking face 21 and lies directly above the latter after the firing pin has fired a shot. This ensures that a displacement of the safety slider 4 into the safety position is not possible when the firing pin has struck.

As can be seen from FIG. 1, the securing element 6, configured as a pushbutton and movably guided inside a bore 37 of the safety slider 4, is constructed in such a manner that a rear part 38 of the securing element 6, as viewed in the direction of displacement of the safety slider 4 into the upper, unsecured position, is flush with the upper side of the safety slider 4 or is slightly offset to the inside, while a front part 39 projects relative to the upper side of the safety slider 4. Thereby an unintended actuation of the securing element 6 can be avoided. For easier operation of the safety slider 4, fluting 40 is provided on its upper side.

All references cited herein are expressly incorporated by reference in their entirety. In addition, unless mention was made above to the contrary, it should be noted that all of the accompanying drawings are not to scale. There are many different features to the present invention and it is contemplated that these features may be used together or separately. Thus, the invention should not be limited to any particular combination of features or to a particular application of the invention. Further, it should be understood that variations and modifications within the spirit and scope of the invention might occur to those skilled in the art to which the invention pertains. Accordingly, all expedient modifications readily attainable by one versed in the art from the disclosure set forth herein that are within the scope and spirit of the present invention are to be included as further embodiments of the present invention.

The invention claimed is:

1. Safety for a repeating rifle, the safety comprising:

a safety slider movable between a rifle safety position and a rifle unsecured position on a lock positioned in a rear opening of a bolt chamber of a repeating rifle, and a locking member operatively associated with the safety slider for blocking or releasing a firing pin nut displaceably arranged in a lock, wherein the locking member includes a safety lever, rotatable about a first transverse pin, with a control part engaging with a control groove on a firing pin nut and wherein the safety lever contains a rear control edge for engagement with a front cam surface of a firing pin.

2. Safety according to claim 1, wherein the safety lever has a rounded-off upper part for engagement in a groove on an underside of the safety slider.

3. Safety according to claim 1, wherein the safety lever has a lower locking face that runs parallel to an upper locking face of a firing pin nut in the rifle unsecured position of the safety slider.

4. Safety for a repeating rifle, the safety comprising:

a safety slider movable between a rifle safety position and a rifle unsecured position on a lock positioned in a rear opening of a bolt chamber of a repeating rifle, and a locking member operatively associated with the safety slider for blocking or releasing a firing pin nut displaceably arranged in a lock, wherein the locking member includes a safety lever, rotatable about a first transverse pin, with a control part engaging with a control groove on a firing pin nut and wherein a securing element for detachably holding the safety slider in the rifle safety and rifle unsecured positions is arranged on the safety slider.

5. Safety according to claim 4, wherein the securing element is constructed as a pushbutton displaceable in the safety slider.

6. Safety according to claim 4, wherein a part behind the securing element as viewed in the direction of displacement of the safety slider into the upper rifle unsecured position is flush with the upper side of the safety slider, while a front part projects relative to the upper side of the safety slider.

7. Safety according to claim 4, wherein the securing element contains a second transverse pin for engagement in lower and upper catch grooves on a lock.

8. Safety for a repeating rifle, the safety comprising:

a safety slider movable between a rifle safety position and a rifle unsecured position on a rifle lock positioned in a rear opening of a bolt chamber of a repeating rifle, and a locking member operatively associated with the safety slider for blocking or releasing a firing pin nut displaceably arranged in a rifle lock, wherein the locking member includes a safety lever, rotatable about a first transverse pin, with a control part engaging with a control groove on a firing pin nut and wherein a bolt chamber connected to a rifle lock has a locking groove for locking engagement of a protrusion of a sear arm in the rifle safety position of the safety slider.

9. A safety system for a repeating rifle, the safety system comprising:

a lock positioned in a rear opening of a bolt chamber of a rifle; and a safety comprising:

a safety slider movable between a rifle safety position and a rifle unsecured position on the lock; and a locking member operatively associated with the safety slider for selectively blocking or releasing a firing pin nut displaceably arranged in the lock, wherein the locking member includes a safety lever, rotatable about a first transverse pin, with a control part engaging with a control groove on a firing pin nut.

10. The safety system according to claim 9, wherein a securing element for detachably holding the safety slider in the rifle safety and rifle unsecured positions is arranged on the safety slider.

11. The safety system according to claim 10, wherein the securing element is a pushbutton displaceable in the safety slider.

12. The safety system according to claim 10, wherein the securing element includes a second transverse pin for engagement in lower and upper catch grooves on the lock.

13. The safety system according to claim 9, wherein a bolt chamber connected to the lock has a locking groove for locking engagement of a protrusion of a sear arm in the rifle safety position of the safety slider.

* * * * *